US005976213A

United States Patent [19]

Rolander et al.

[11] Patent Number: 5,976,213

[45] Date of Patent: Nov. 2, 1999

[54] TITANIUM-BASED CARBONITRIDE ALLOY WITH IMPROVED THERMAL SHOCK RESISTANCE

[75] Inventors: Ulf Rolander, Stockholm; Gerold Weinl, Älvsjö; Camilla Odén, Sandviken; Per Lindahl, Lindome, all of Sweden

[73] Assignee: Sandvik AB, Sandviken, Sweden

[21] Appl. No.: 09/075,221

[22] Filed: May 11, 1998

[30] Foreign Application Priority Data

May 15, 1997 [SE] Sweden ..... 9701858

[51] Int. Cl.[6] ..... C22C 29/04

[52] U.S. Cl. ..... 75/238; 75/237; 419/10; 419/47; 419/56

[58] Field of Search ..... 75/237, 238, 242; 419/47, 10, 56

[56] References Cited

U.S. PATENT DOCUMENTS

| | | | |
|---|---|---|---|
| 4,769,070 | 9/1988 | Tobioka et al. | 75/238 |
| 4,985,070 | 1/1991 | Kitamura et al. | 75/238 |
| 5,145,505 | 9/1992 | Saito et al. | 75/238 |
| 5,856,032 | 1/1999 | Daub et al. | 428/697 |

*Primary Examiner*—Ngoclan Mai

*Attorney, Agent, or Firm*—Burns, Doane, Swecker & Mathis, L.L.P.

[57] ABSTRACT

A titanium-based carbonitride cutting tool insert with superior thermal shock resistance is disclosed. This is accomplished by sintering the material under conditions where the melting process is reversed. The melt forms in the center of the material first and the melting front propagates outwards towards the surface. This leads to minimal porosity and a macroscopic cobalt depletion towards the surface. The cobalt depletion, in turn, leads to a favorable compressive residual stress in the surface zone.

14 Claims, 3 Drawing Sheets

TITANIUM-BASED CARBONITRIDE ALLOY WITH IMPROVED THERMAL SHOCK RESISTANCE

This application claims priority under 35 U.S.C. §§119 and/or 365 to 9701858-4 filed in Sweden on May 15, 1997; the entire content of which is hereby incorporated by reference.

BACKGROUND OF THE INVENTION

The present invention relates to a liquid phase sintered body of a carbonitride alloy with titanium as main component which alloy has improved properties particularly when used as a cutting tool material in cutting operations requiring high thermal shock resistance. These improved properties have been achieved by processing the material in a specific way to obtain a lower melting point of the liquid phase in the interior of the body compared to the surface. In this way the porosity and residual oxygen content are minimized and, in addition, a binder phase gradient leading to a beneficial compressive residual stress in the surface zone can be produced.

Titanium-based carbonitride alloys, so called cermets, are today well established as insert material in the metal cutting industry and are especially used for finishing. They comprise carbonitride hard constituents embedded in a metallic binder phase. The hard constituent grains generally have a complex structure with a core surrounded by a rim of other composition.

In addition to titanium, group VIa elements, normally both molybdenum and tungsten and sometimes chromium, are added to facilitate wetting between binder and hard constituents and to strengthen the binder by means of solution hardening. Group IVa and/or Va elements, i.e., Zr, Hf, V, Nb and Ta, are also added in all commercial alloys available today. All these additional elements are usually added as carbides, nitrides and/or carbonitrides. The grain size of the hard constituents is usually <2 $\mu$m. The binder phase is normally a solid solution of mainly both cobalt and nickel. The amount of binder phase is generally 3–25 wt %. Other elements are sometimes added as well, e.g., aluminum, which are said to harden the binder phase and/or improve the wetting between hard constituents and binder phase.

Despite more than 20 years of intense development efforts world-wide, it has not heretofore been possible to increase the rather narrow application area of cermets. They are still limited to finishing or at most semi-finishing operations requiring moderate wear resistance and toughness. U.S. Pat. No. 4,985,070 discloses a process for producing a high strength cermet by sintering the material in progressively increasing nitrogen partial pressure to eliminate denitrification and obtain better control of the final nitrogen content. This is useful to obtain improved process control during conventional sintering especially of cermets with extremely high nitrogen content. Unfortunately, it also eliminates the possibility of producing different melting points in different parts of the material, the process utilized in the present invention.

Through WO 96/22403, which corresponds to U.S. Ser. No. 08/875,139, and WO 97/04143, which corresponds to U.S. Ser. No. 08/981,844, both references herein incorporated by reference, the limited wear resistance of cermets has been overcome and a significant step forward has been taken towards tougher material. This is accomplished by optimizing the raw material compositions and by applying CVD coatings onto suitable cermet alloys to obtain compressive residual stresses in the coating which increases toughness. In both cases, a conventional sintering technique was used. However, further steps toward improved toughness, in particular improved thermal shock resistance, need to be taken to compete with CVD-coated WC-Co based alloys in many applications demanding toughness. When doing so, it is most probably necessary to find novel processing methods. Continued optimization mainly of chemical composition and raw material compositions is not likely to have the desired effect.

OBJECTS AND SUMMARY OF THE INVENTION

It is an object of this invention to avoid or alleviate the problems of the prior art.

It is also an object of the present invention to provide a sintered titanium-based carbonitride alloy, having minimum porosity and oxygen content, and a compressive residual stress in the surface zone, both leading to significantly improved thermal shock resistance, and a method for producing such alloys.

In one aspect of the invention, there is provided a sintered titanium-based carbonitride alloy containing hard constituents based on Ti, Zr, Hf, V, Nb, Ta, Cr, Mo and/or W in a cobalt binder phase wherein said insert has a macroscopic cobalt gradient in which the cobalt content decreases essentially monotonously from the center of the insert to its surface and reaches a cobalt content in a zone 0–9 $\mu$m below the surface of 50–99% of that in the center.

In another aspect of the invention, there is provided a method of manufacturing by liquid phase sintering a body of titanium-based carbonitride alloy, containing hard constituents based on Ti, Zr, Hf, V, Nb, Ta, Cr, Mo and/or W in a cobalt binder phase comprising sintering said body such that a liquid binder phase forms in the center of the body first and a melting front then propagates outwards towards the surface.

DETAILED DESCRIPTION OF THE PREFERRED EMBODIMENTS OF THE INVENTION

Figure 1:
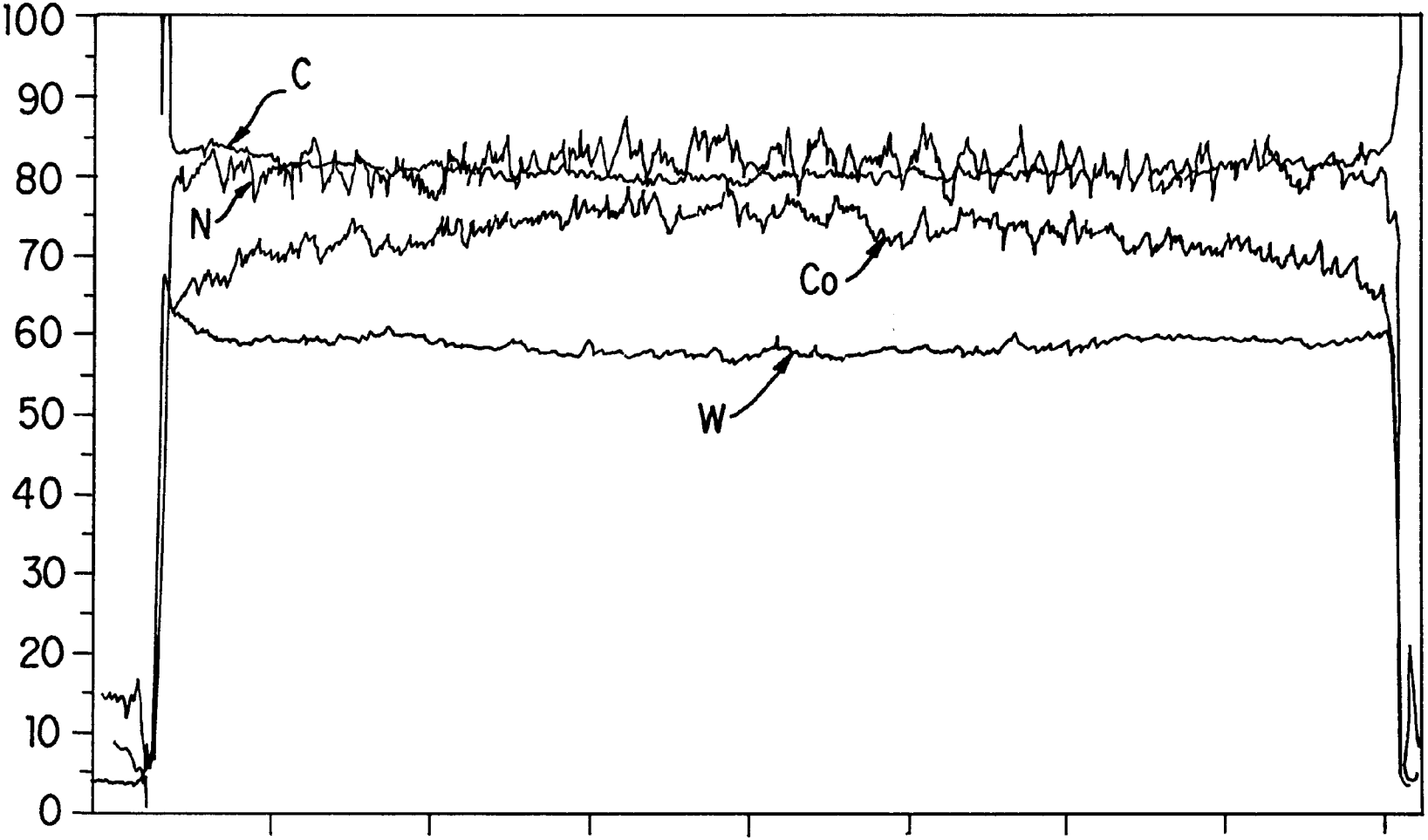
FIG. 1 shows an EMPA (Electron Microprobe Analysis) line scan analysis of Co, N, W and C through one side of an insert of the present invention.

The sintered titanium-based carbonitride alloy of the present invention contains 2–15 atomic %, preferably 2–7 atomic %, tungsten and/or molybdenum. Apart from titanium, the alloy contains 0–15 atomic % of group Iva and/or group Va elements, preferably 0–5 atomic % tantalum and/or niobium. As the binder phase forming element 5–25 atomic %, preferably 9–16 atomic %, cobalt is added. The alloy has a N/(C+N) ratio in the range 10–60 atomic %, preferably 25–51 atomic %. The alloy must not contain nickel and/or iron apart from inevitable impurities (e.g., 0.5% max). If these binder forming elements are included, the novel process reverts to a conventional one and the desired microstructure cannot be produced. Most preferably, no elements apart from C, N, Ti, W, Ta and Co are intentionally added.

In a first preferred embodiment useful for toughness demanding applications requiring relatively low plastic deformation resistance, the composition is 3–5 atomic % W, 10.5–14 atomic % Co, 25–50% N/(C+N), balance Ti.

In a second preferred embodiment useful for applications requiring relatively high plastic deformation resistance, the composition is 3–5 atomic % W, 6–14 atomic %, preferably 10.5–14 atomic % Co, 25–50% N/(C+N), 1–4 atomic % Ta, balance Ti.

In a third preferred embodiment useful for applications requiring especially high thermal shock resistance, the composition is 75–90% Co in the surface compared to the center of the alloy.

In a fourth embodiment the composition is 95–99% Co in the surface compared to the center of the alloy. This is useful, e.g., for special insert geometries requiring grinding so that only the positive effect of the reversed melting direction but not the cobalt gradient itself can be utilized.

The microstructure is characteristic for an alloy which has melted from the center outwards towards the surface, i.e., where shrinkage due to pore elimination starts in the center and propagates outwards. Porosity and residual oxygen content are minimized, that is, porosity class A02 or less and an oxygen content below 0.8, preferably below 0.5, atomic % and a macroscopic, essentially parabolic cobalt gradient exists where the cobalt content decreases monotonously, apart from normal statistical fluctuations, from the center of the alloy to the surface. The average cobalt content as measured in a zone 0–9 $\mu$m below the surface is 50–99%, preferably 75–99%, most preferably 75–97.5%, of the cobalt content in the center of the alloy. This gradient leads to a monotonously increasing compressive residual stress in the hard phase skeleton from the center towards the surface. The alloy may be coated with at least one wear resistant coating, preferably using the techniques described in WO 97/04143, which corresponds to U.S. Ser. No. 08/981,844. This alloy has superior thermal shock resistance and is suitable as a cutting tool material.

In another aspect of the invention, there is provided a method of manufacturing a sintered carbonitride alloy in which powders of carbides, carbonitrides and/or nitrides are mixed with cobalt to a prescribed composition and pressed into green bodies of desired shape. The green bodies are liquid phase sintered in vacuum or a controlled gas atmosphere at a temperature in the range 1370–1500° C., depending on composition. In the heating part of the sintering cycle, before the maximum temperature is reached, a deoxidation and denitrification step is included which gives the alloy its superior properties. Due to this step, the liquid binder phase nucleates first in the center of the alloy. The melting front then propagates outwards towards the surface. During normal liquid phase sintering, melting starts at the surface and propagates inwards, towards the center. Reversing the melting direction has two desirable effects. First, any residual gas is pushed out from the green body instead of being trapped when the porosity is closed. In this way residual porosity in the sintered alloy is minimized, leading to higher strength. Secondly, as the melting front moves through the alloy, the capillary forces of the molten binder produce the macroscopic cobalt gradient described above. This gradient is stable through the remainder of the sintering process and its magnitude can be controlled with good accuracy.

At temperatures above about 900° C. deoxidation of the surface of individual Ti-containing hard phase grains occurs, as oxygen originating from these surfaces leaves the green bodies in the form of carbon monoxide gas (CO). In this way, carbon is taken predominantly from the same surface, thus decreasing the stoichiometry of the surface. At temperatures above about 1250° C., denitrification of the surface of individual nitrogen containing hard phase grains occurs as nitrogen originating from these surfaces leaves the green bodies in the form of nitrogen gas ($N_2$). Denitrification also decreases the stoichiometry of the surface. The relative efficiency of the two processes determines the C/N ratio of the surface. The oxygen and nitrogen content on the surface is determined by the temperature and the partial pressures of CO and $N_2$, respectively, outside the surface. Increasing the temperature or decreasing the partial pressures will decrease the O- and/or N-content on the surface.

It has quite surprisingly turned out that, for the compositions specified above, the deoxidation and denitrification processes described above can be utilized to obtain a substantially lower melting point in the center of the green body compared to the surface. This is achieved by an appropriate combination of temperature ramp (rate of increase) and CO- and $N_2$ partial pressures in the furnace in the temperature range between 900° C. and until a liquid binder has formed throughout the material (normally in the range 1350–1430° C. depending on composition). The reason for this has turned out to be that gas transport through the open porosity of the green bodies is a much slower process than was previously thought. It is thus possible to maintain significant CO- and/or $N_2$ pressure gradients through the green body, with highest pressures in the center and lowest at the surface. The magnitude of these gradients are controlled by the rate of gas formation inside the green body, the average pore size through which gas transport occurs and the partial pressures at the surface of the green body. The rate of gas formation depends on the C/N ratio in the alloy, the stoichiometry of the raw material and the degree of surface oxidation of the raw material grains. By keeping these parameters constant, the rate of gas formation can be controlled by the slope of the temperature ramp. A steeper ramp leads to a higher rate of gas formation. The average pore size increases with increasing grain size and decreasing compaction pressure when pressing the green bodies. The partial pressures of CO- and $N_2$-gas at the green body surface is controlled by the vacuum pump capacity or by using a controlled furnace atmosphere, either as stationary gas or as flowing gas. Stationary gas may originate from the green bodies themselves or be added from an external source.

Hard phase grains situated at a given depth, from the green body surface will obtain a surface stoichiometry and/or surface C/N ratio determined by the CO and $N_2$ pressure in the open porosity at that depth. Increased stoichiometry and/or C/N ratio leads to decreased melting point. Thus, the lowest melting point will be obtained in the center of the green body where the CO and $N_2$ pressures are highest. A large difference in melting point between green body surface and center leads to a large cobalt gradient. Since the parameters governing the pressure gradient through the green body, and thus the difference in melting point obtained, are intimately connected, the appropriate combination of conditions must be determined experimentally. However, in the most critical temperature interval, between 1300° C. and that temperature at which a fully molten binder exists (normally about 1400° C.), the temperature ramp should lie in the range 0.5–15° C./minute, but can be interrupted with optional temperature plateau when needed, e.g., to pump away excessive gas originating from the green bodies. During the same temperature interval the CO- and $N_2$ partial pressures should be kept below 20 mbar, preferably below 15 mbar Co and most preferably below 5 mbar $N_2$ , in order not to reverse the pressure gradients and initiate the melting process at the surface. A thin molten surface zone that essentially does not propagate inwards is acceptable. Such a zone may be obtained due to radiation heating and will not lead to pore closure as long as it is sufficiently thin.

Since the process is controlled by reactive gases in the sintering atmosphere, it is a definite advantage to place the green bodies on a surface which is inert to this atmosphere. One good example of this is yttria coated graphite trays, as described in WO 97/40203, which corresponds to U.S. Ser. No. 08/837,094, herein incorporated by reference. Using zirconia or graphite in contact with the green bodies has in some cases led to an asymmetric cobalt gradient from top to bottom of the insert. This is unacceptable since the performance will vary between different cutting edges on the insert.

The invention is additionally illustrated in connection with the following Examples which are to be considered as illustrative of the present invention. It should be understood, however, that the invention is not limited to the specific details of the Examples.

EXAMPLE 1

A powder mixture with a chemical composition of (atomic %) 40.7% Ti, 3.6% W, 30.4% C, 13.9% N and 11.4% Co was manufactured from Ti(C,N), WC and Co raw material powders. The mean grain size of the Ti(C,N) and WC powders were 1.4 $\mu$m. The powder mixture was wet milled, dried and pressed into green bodies of the insert type CNMG 120408-PM at a compaction pressure of 130 MPa. The green bodies were dewaxed in $H_2$ at a temperature below 350° C. The furnace was then evacuated and pumping was maintained throughout the temperature range 350–1430° C. From 350 to 1200° C., a temperature ramp of 10° C./minute was used. The temperature was then held at 1200° C. for 30 minutes to pump out excessive gas originating from the inserts. A temperature ramp of 4° C./minute was then applied in the interval 1200–1430° C. The sum of the CO and $N_2$ partial pressures was about constant at 0.01 mbar from 1300° C. until 1430° C. when the open porosity was closed (i.e., the melting front had reached the surface) and the pressure had decreased somewhat. The inserts were liquid phase sintered at 1430° C. for 90 minutes in a 10 mbar Ar atmosphere.

Polished cross sections of the inserts were prepared by standard metallographic techniques and characterised using optical microscopy and electron microprobe analysis (EMPA). Optical microscopy showed that the inserts were free from residual pores (porosity class A00). FIG. 1 shows an EMPA line scan analysis of Co, N, W and C ranging from one side of the insert, through the interior of the material and to the opposite surface. Clearly, the cobalt content decreases monotonously from the center towards the surface, while the concentration of the other elements is fairly constant across the insert. At the surface the cobalt content is about 87% of that in the center.

EXAMPLE 2

Figure 2:
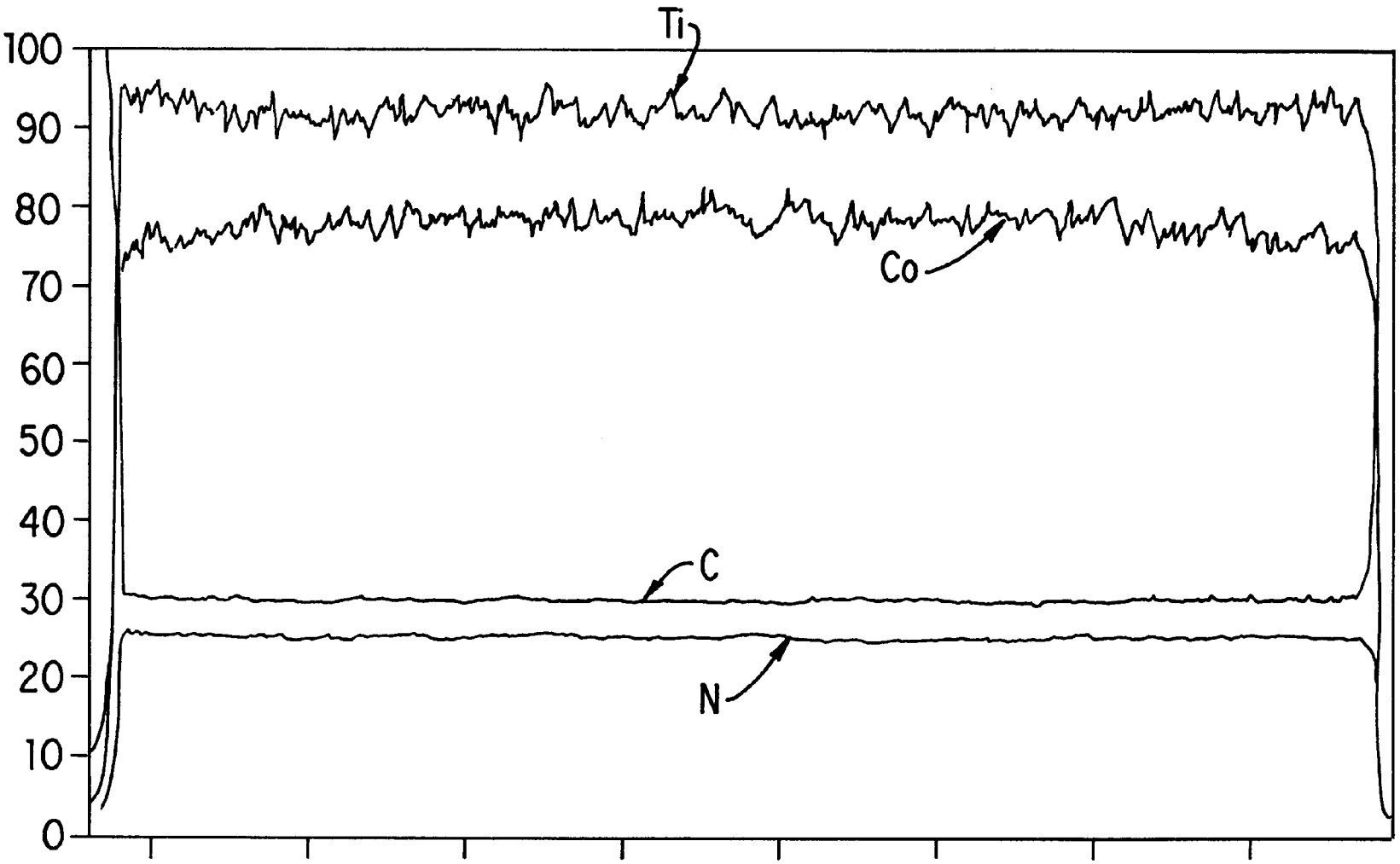
FIG. 2 also shows an EMPA line scan analysis of Co, N, W and C through one side of an insert of the present invention.

In a second experiment, inserts were manufactured in an identical manner as described in Example 1, except that the valve to the vacuum pump was kept closed in the temperature interval 1300–1430° C. During this interval, the temperature interval was lowered to 3° C./minute. The sum of the CO- and $N_2$ partial pressures increased linearly from about 0.01 mbar at 1300° C. to about 6 mbar at 1360° C. when the open porosity was closed and the pressure stopped increasing. FIG. 2 shows an EMPA line scan analysis of this material, obtained under identical conditions as in Example 1. Again, the cobalt content decreases monotonously from the center towards the surface, while the concentration of the other elements is fairly constant across the insert. At the surface the cobalt content is about 95% of that in the center. The slower temperature ramp, in combination with the higher partial pressures of CO- and $N_2$ gas in the furnace have decreased the magnitude of the cobalt gradient considerably. Optical microscopy showed that the inserts were free from residual pores (porosity class A00).

EXAMPLE 3

In a third experiment, inserts of the geometry SNUN120408 were manufactured in an identical manner as described in Example 1, except that in three separate runs the sintering cycle was stopped at 1200° C. after the 30 minute plateau, at 1350° C. and at 1400° C. respectively. The furnace was allowed to cool down and the inserts from the different runs were inspected. Characteristic for this insert geometry is that all six sides of both unsintered and fully sintered insert are flat. Inspection of the inserts from the three interrupted runs showed that at 1200° C., the inserts had shrunk linearly about 5% compared to the dimensions of the unsintered green body. All sides were completely flat. This amount of shrinkage is expected to be obtained from solid state sintering, a process occurring before any liquid phase has formed. At 1350° C., the inserts had shrunk 11%. Now all six sides were visibly concave, clear evidence that shrinkage due to liquid formation has started in the center of the insert. At 1400° C., the inserts had nearly reached their fully sintered dimensions (18% linear shrinkage compared to the green body). All sides were markedly concave showing that the melting front had not yet reached the outermost edges of the insert. For an insert melting in the opposite direction, the sides are expected to stay flat or possibly convex during shrinkage.

EXAMPLE 4

In a fourth experiment, inserts were manufactured in an identical manner as described in Example 2, except that in the temperature interval 1300–1430° C., a gas mixture of 10% $N_2$ and 90% CO was allowed to flow through the furnace. Simultaneously, the pumping capacity was adjusted to simulate the pressure increment obtained in Example 2. EMPA line scan analysis of the material, showed an identical Co-profile as obtained in Example 2. This is clear evidence that it is in fact the $N_2$ and CO partial pressures that determine the structure since all other gases have very low partial pressures when the experiment is performed in this manner.

EXAMPLE 5 (COMPARATIVE)

In a fifth experiment, inserts were manufactured in an identical manner as described in Example 4, except that in the temperature interval 1300–1430° C., the pumping capacity was adjusted to obtain a faster pressure increment compared to Example 4. The pressure was allowed to increase to 20 mB at 1430° C. EMPA line scan analysis of the material, showed a complete absence of Co-profile. Optical microscopy showed a large core region with significant porosity (A06), while the surface zone was essentially pore free (A00). Furthermore, this material showed an increase in magnetic saturation of about 15% compared to the material of Example 4, indicating a higher carbon content. Chemical analysis showed that both the carbon and oxygen content was about 0.2 wt % higher for this material compared to Example 4. The result obtained is strong evidence that the porosity is closed from the surface and that (predominantly) CO gas is trapped in the material.

EXAMPLE 6 (COMPARATIVE)

As a reference, CNMG120408-PM inserts were manufactured of a powder mixture consisting of (in atomic-%) 8.3 Co, 4.25 Ni, 43.8 Ti, 2.5 Ta, 0.8 Nb, 4.2 W, 2 Mo, 26.6 C and 16.6 N using an identical sintering process as in Example 1.

These inserts were coated with an about 4 μm thick Ti(C, N)-layer and a less than 1 μm thick TiN-layer using the physical vapor deposition technique (PVD). This is a well established PVD-coated cermet grade within the P25-range for turning and is characterised in particular, by good toughness.

Figure 3:
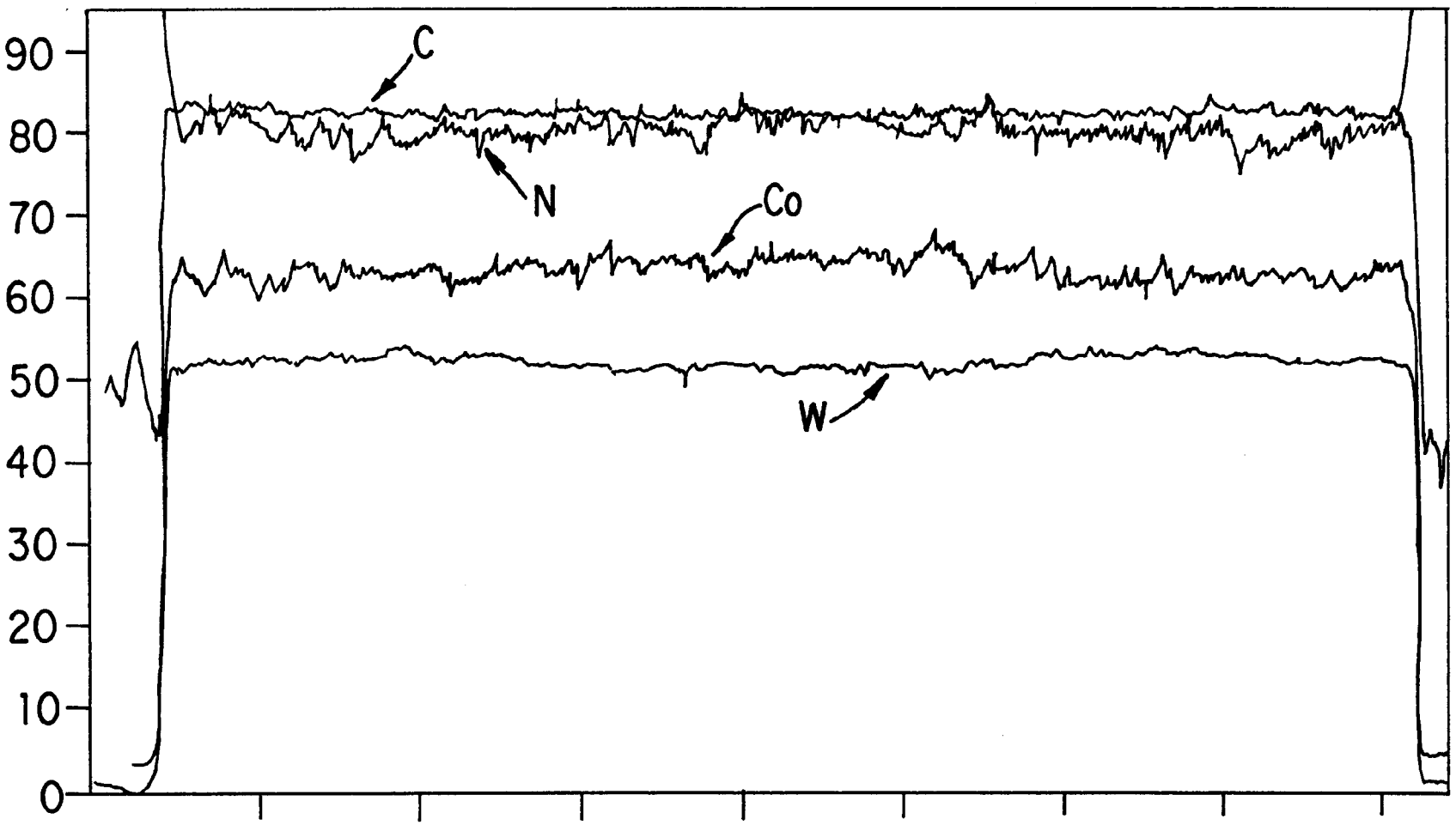
FIG. 3 shows an EMPA line scan analysis of Co, N, W and C through one side of a comparative insert.

FIG. 3 shows an EMPA line scan analysis of this material obtained under identical conditions as in Example 1. This material does not have a Co-gradient, in spite of a sintering process that gave a large gradient for the composition used in Example 1. The reason is the large amount of nickel used in this material. Light optical microscopy showed that this material has normal residual porosity (porosity class A02).

EXAMPLE 7

In order to test the toughness of the material in Example 1, inserts were both PVD coated (insert A), using the same process as in example 4, and CVD coated (insert B) using a thick coating consisting of 10 μm Ti(C,N) and 5 μm A1203. The thin PVD coating can be expected to have only marginal effect on the toughness of the insert, while the CVD coating, due to its thickness, can be expected to decrease the toughness dramatically. The thermal shock resistance of the inserts was tested in a facing operation with cutting fluid, using a cylindrical bar of SS2511 steel as workpiece material. Inserts from Example 4 were used as reference (insert C). Thermal cycling was obtained by performing each facing pass as a sequence of nine separate cuts where the cutting fluid was allowed to cool the cutting edge between each individual cut. Tool life criterion was edge fracture or 30 full passes. The number of passes needed to reach end of tool life was measured for each cutting edge and three edges per variant were tested. The speed was 400 m/min, the feed 0.35 mm/revolution and the depth of cut was 2 mm. The result is given in the Table below.

| Edge No | Insert A | Insert B | Insert C |
|---|---|---|---|
| 1 | 30.0 | 8.2 | 0.2 |
| 2 | 15.4 | 8.1 | 0.2 |
| 3 | 25.0 | 9.0 | 0.2 |
| average | 23.5 | 8.4 | 0.2 |

Comparing the results of inserts A and C, which have identical coating, it is clear that the thermal shock resistance is dramatically improved by the invention. Even with a thick brittle coating, insert B, fractures caused by thermal cycling is delayed considerably.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A cutting tool insert of sintered titanium-based carbonitride alloy containing hard constituents based on Ti, Zr, Hf, V, Nb, Ta, Cr, Mo and/or W in a cobalt binder phase wherein said insert has a macroscopic cobalt gradient in which the cobalt content decreases essentially monotonously from the center of the insert to its surface and reaches a cobalt content in a zone 0–9 μm below the surface of 50–99% of that in the center.

2. The cutting tool insert of claim 1 wherein the said insert contains porosity in the class A02 or less.

3. The cutting tool insert of claim 1 wherein the alloy contains apart from inevitable impurities in addition to titanium, 2–15 atomic % tungsten and/or molybdenum, 0–15 atomic % of group IVa and/or group Va elements apart from titanium, tungsten and/or molybdenum, 5–25 atomic % cobalt and with an average N/(C+N) ratio in the range 10–60 atomic %.

4. The cutting tool insert of claim 3 wherein the alloy contains 2–7 atomic % tungsten and/or molybdenum, 0–5 atomic % tantalum and/or niobium, 9–16 atomic % cobalt and with an average N/(C+N) ratio in the range 25–51 atomic %.

5. The cutting tool insert of claim 1 wherein said carbonitride alloy contains no nickel or iron except as impurities.

6. The cutting tool insert of claim 1 wherein said insert is provided with at least one wear resistant coating comprising Ti and/or Al.

7. Method of manufacturing by liquid phase sintering a body of titanium-based carbonitride alloy, containing hard constituents based on Ti, Zr, Hf, V, Nb, Ta, Cr, Mo and/or W in a cobalt binder phase comprising sintering said body such that a liquid binder phase forms in the center of the body first and a melting front then propagates outwards towards the surface.

8. The method of manufacturing the sintered body of claim 7 wherein sintering is conducted at a temperature range between 1300° C. and until all cobalt becomes molten, the temperature increment lies in the range 0.5–15° C/min, apart from optional temperature plateau.

9. The method of manufacturing the sintered body of claim 8 wherein during sintering in the temperature interval between 1300° C. and until all cobalt becomes molten, the CO- and $N_2$ partial pressures in the furnace are kept below 20 mbar.

10. The method of manufacturing the sintered body of claim 9 wherein the CO- and $N_2$ partial pressures in the furnace are kept below 15 mbar.

11. The method of manufacturing the sintered body of claim 9 wherein the CO- and $N_2$ partial pressures in the furnace are kept below 5 mbar.

12. The method of manufacturing the sintered body of claim 8 wherein the body contains apart from inevitable impurities in addition to titanium, 2–15 atomic % tungsten and/or molybdenum, 0–15 atomic % of group IVa and/or group Va elements apart from titanium, tungsten and/or molybdenum, 5–25 atomic % cobalt and with an average N/(C+N) ratio in the range 10–60 atomic %.

13. The method of manufacturing the sintered body of claim 12 whereinn the body contains 2–7 atomic % tungsten and/or molybdenum, 0–5 atomic % tantalum and/or niobium, 9–16 atomic % cobalt and with an average N/(C+N) ratio in the range 25–51 atomic %.

14. The method of manufacturing the sintered body of claim 7 wherein the body is sintered on an yttria surface.

* * * * *